US008302707B2

(12) United States Patent
Lyon

(10) Patent No.: US 8,302,707 B2
(45) Date of Patent: Nov. 6, 2012

(54) DOWN-THE-HOLE DRILL REVERSE EXHAUST SYSTEM

(75) Inventor: Leland Lyon, Roanoke, VA (US)

(73) Assignee: Center Rock Inc., Berlin, PA (US)

( * ) Notice: Subject to any disclaimer, the term of this patent is extended or adjusted under 35 U.S.C. 154(b) by 200 days.

(21) Appl. No.: 12/361,263

(22) Filed: Jan. 28, 2009

(65) Prior Publication Data

US 2010/0187017 A1 Jul. 29, 2010

(51) Int. Cl.
*E21B 4/14* (2006.01)
*E21B 1/38* (2006.01)

(52) U.S. Cl. ..... 175/296; 173/125

(58) Field of Classification Search ..... 175/91, 175/17, 78, 135, 136, 15, 296, 293; 173/91, 173/17, 78
See application file for complete search history.

(56) References Cited

U.S. PATENT DOCUMENTS

| | | | | |
|---|---|---|---|---|
| 1,815,660 | A | 7/1931 | Walker | |
| 2,379,472 | A | 7/1945 | Bowman | |
| 2,710,740 | A * | 6/1955 | Dempsey | 175/92 |
| 3,893,521 | A * | 7/1975 | Bailey et al. | 173/80 |
| 3,991,834 | A | 11/1976 | Curington | |
| 4,050,525 | A * | 9/1977 | Kita | 173/17 |
| 4,085,809 | A | 4/1978 | Lovell et al. | |
| 4,333,537 | A | 6/1982 | Harris et al. | |
| 4,530,408 | A | 7/1985 | Toutant | |
| 4,691,779 | A | 9/1987 | McMahan et al. | |
| 4,765,418 | A | 8/1988 | Ennis | |
| 4,819,739 | A | 4/1989 | Fuller | |
| 4,878,550 | A * | 11/1989 | Chuang | 175/296 |
| 4,919,221 | A | 4/1990 | Pascale | |
| 5,065,827 | A | 11/1991 | Meyers et al. | |
| 5,085,284 | A | 2/1992 | Fu | |
| 5,301,761 | A | 4/1994 | Fu et al. | |
| 5,305,837 | A | 4/1994 | Johns et al. | |
| 5,322,136 | A | 6/1994 | Bui et al. | |
| 5,322,139 | A | 6/1994 | Rose et al. | |
| 5,398,772 | A | 3/1995 | Edlund | |
| 5,794,516 | A | 8/1998 | Wolfer et al. | |
| 5,915,483 | A | 6/1999 | Gien | |
| 5,984,021 | A | 11/1999 | Pascale | |
| RE36,848 | E | 9/2000 | Bui et al. | |
| 6,125,952 | A | 10/2000 | Beccu et al. | |

(Continued)

FOREIGN PATENT DOCUMENTS

EP 1910640 B1 4/2008

(Continued)

OTHER PUBLICATIONS

International Search Report and Written Opinion for the related International Application No. PCT/US2009/038957 issued on May 26, 2009.

(Continued)

*Primary Examiner* — Thomas Beach
*Assistant Examiner* — James Sayre
(74) *Attorney, Agent, or Firm* — Kim Krizman LLC

(57) ABSTRACT

A DHD hammer that can exhaust working air volumes partially through a proximal end of the DHD hammer's actuator assembly includes a drive chamber, a return chamber, and a backhead that includes exhaust ports. Working air volumes from the drive chamber are exhausted through the backhead while working air volumes from the drive chamber are exhausted primarily through a drill bit.

18 Claims, 5 Drawing Sheets

U.S. PATENT DOCUMENTS

| | | | | |
|---|---|---|---|---|
| 6,131,672 | A | 10/2000 | Beccu et al. | |
| 6,135,216 | A | 10/2000 | Lyon et al. | |
| 6,170,581 | B1 * | 1/2001 | Lay | 175/296 |
| 6,237,704 | B1 | 5/2001 | Lay | |
| 6,263,969 | B1 | 7/2001 | Stoesz et al. | |
| D454,143 | S | 3/2002 | Asberg | |
| 6,502,650 | B1 | 1/2003 | Beccu | |
| 6,637,520 | B1 | 10/2003 | Purcell | |
| 6,698,537 | B2 | 3/2004 | Pascale et al. | |
| 6,708,784 | B1 | 3/2004 | Borg | |
| 7,017,682 | B2 | 3/2006 | Chan et al. | |
| 7,117,939 | B1 | 10/2006 | Hawley et al. | |
| 7,159,676 | B2 | 1/2007 | Lyon | |
| 7,163,058 | B2 | 1/2007 | Bakke et al. | |
| 7,198,120 | B2 | 4/2007 | Gien | |
| 7,389,833 | B2 | 6/2008 | Walker et al. | |
| 7,467,675 | B2 | 12/2008 | Lay | |
| 7,617,889 | B2 | 11/2009 | Beccu | |
| 2003/0102167 | A1 | 6/2003 | Pascale et al. | |
| 2004/0188146 | A1 | 9/2004 | Egerstrom | |
| 2006/0225885 | A1 | 10/2006 | Mcgarian et al. | |
| 2006/0249309 | A1 | 11/2006 | Cruz | |
| 2007/0039761 | A1 | 2/2007 | Cruz | |
| 2008/0087473 | A1 | 4/2008 | Hall et al. | |
| 2008/0156539 | A1 | 7/2008 | Ziegenfuss | |
| 2010/0059284 | A1 | 3/2010 | Lyon et al. | |
| 2010/0089649 | A1 | 4/2010 | Welch et al. | |
| 2010/0243333 | A1 | 9/2010 | Purcell | |
| 2010/0252330 | A1 | 10/2010 | Gilbert et al. | |

FOREIGN PATENT DOCUMENTS

| | | | |
|---|---|---|---|
| WO | 2007010513 | A1 | 1/2007 |
| WO | 2007077547 | A1 | 7/2007 |
| WO | 2009124051 | A2 | 10/2009 |
| WO | 2010082889 | | 7/2010 |

OTHER PUBLICATIONS

International Search Report and Written Opinion for the related International Application No. PCT/US2010/021011 issued Mar. 19, 2010.

International Preliminary Report on Patentability issued on Oct. 5, 2010 in International Application No. PCT/US2009/038957.

Written Opinion Issued Feb. 22, 2011 in Int'l Application No. PCT/US2010/021011, 4 pages.

Office Action Issued Apr. 11, 2011 in U.S. Appl. No. 12/621,155.

Office Action issued Sep. 15, 2011 in AU Application No. 2009231791.

Office Action issued Jun. 30, 2011 in SE Application No. 1051069-1.

Office Action issued Oct. 18, 2011 in U.S. Appl. No. 12/621,155.

Office Action issued Dec. 23, 2011 in U.S. Appl. No. 12/621,155.

Office Action issued Feb. 1, 2011 in AU Application No. 2009231791.

Int'l Search Report issued May 31, 2011 in Int'l Application No. PCT/US2010/056917; Written Opinion.

Office Action issued Feb. 7, 2012 in Chilean Patent Application No. 1015/2010.

International Preliminary Report on Patentability issued Mar. 13, 2012 in International Application No. PCT/US2010/021011.

Office Action issued Jun. 7, 2012 in U.S. Appl. No. 12/621,155.

Office Action issued Jun. 4, 2012 in Canadian App. No. 2,718,669.

Office Action issued May 14, 2012 in Swedish App. No. 1150769-6.

Office Action issued Jun. 21, 2012 in Swedish App. No. 1150985-8.

* cited by examiner

DOWN-THE-HOLE DRILL REVERSE EXHAUST SYSTEM

BACKGROUND OF THE INVENTION

The present invention relates to a down-the-hole drill ("DHD") hammer. In particular, the present invention relates to a DHD hammer's actuator assembly having a reverse exhaust system.

Typical DHD hammers include a piston that is moved cyclically with high pressure gas (e.g., air). The piston generally has two end surfaces that are exposed to working air volumes (i.e., a return volume and a drive volume) that are filled and exhausted with each cycle of the piston. The return volume pushes the piston away from its impact point on a bit end of the hammer. The drive volume accelerates the piston toward its impact location.

Typical DHD hammers also combine the exhausting air from these working air volumes into one central exhaust gallery that delivers all the exhausting air through the drill bit and around the externals of the DHD hammer. In most cases, about 30% of the air volume is from the DHD hammer's return chamber, while about 70% is from the hammer's drive chamber. However, this causes much more air then is needed to clean the bit-end of the hammer (e.g., the holes across the bit face). Such high volume air passes through relatively small spaces creating high velocity flows as well as backpressure within the DHD hammer. This is problematic as such high velocity air along with solids (i.e., drill cuttings) and liquids moved by the high velocity air causes external parts of the DHD hammer to wear rapidly while backpressures within the DHD hammer reduces the tool's overall power and performance.

A DHD hammer, such as the present invention, having a reverse exhaust system reduces the amount of high velocity air along the bit-end thereby reducing the overall wear on the DHD hammer. Moreover, the present invention provides for reduced backpressures within the DHD hammer that allows for improved power and performance of the tool.

BRIEF SUMMARY OF THE INVENTION

In accordance with the present invention the problems associated with exhausting high velocity air volumes across the external surfaces of a DHD hammer, and in particular across the drill bit faces are solved by engendering a DHD hammer that exhausts working air volumes about both a proximal end of the DHD hammer and a distal end of the DHD hammer.

In a preferred embodiment, the present invention provides for a down-the-hole drill actuator assembly comprising: a drive chamber configured to exhaust working fluid volumes through a backhead; a return chamber configured to exhaust working fluid volumes through a drill bit; and a solid core piston between the drive chamber and the return chamber.

In another preferred embodiment, the present invention provides for a down-the-hole drill actuator assembly comprising: a casing; a backhead configured within the casing, the backhead including: a cylindrical member; a central bore within the cylindrical member; a check valve assembly within the central bore; a supply inlet in communication with the central bore; an exhaust valve stem in communication with the central bore; and at least one exhaust port in communication with the exhaust valve stem; and a piston housed within the casing and operatively associated with the backhead, the piston comprising a bore partially sized to exhaust a portion of a fluid within the casing there through.

In a further preferred embodiment, the present invention provides for an actuator assembly comprising: a casing; a piston housed within the casing, the piston comprising a thru-bore sized to allow a fluid within the casing to partially exhaust through; a drill bit connected to a distal end of the casing and operatively associated with the piston; and a backhead connected to a proximal end of the casing and operatively associated with the piston, the backhead comprising: an exhaust port; and an exhaust valve stem in communication with the exhaust port, and wherein the exhaust port exhausts the fluid; a drive chamber formed within the casing and in communication with the exhaust valve stem; a return chamber distal to the drive chamber, formed by an inner wall surface of the casing and an outer surface of the piston; and wherein the fluid is supplied to the drive chamber through the supply inlet, and wherein the casing, piston, and backhead are configured to exhaust fluid within the drive chamber through the exhaust port, and exhaust fluid within the return chamber through an opening in the drill bit.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
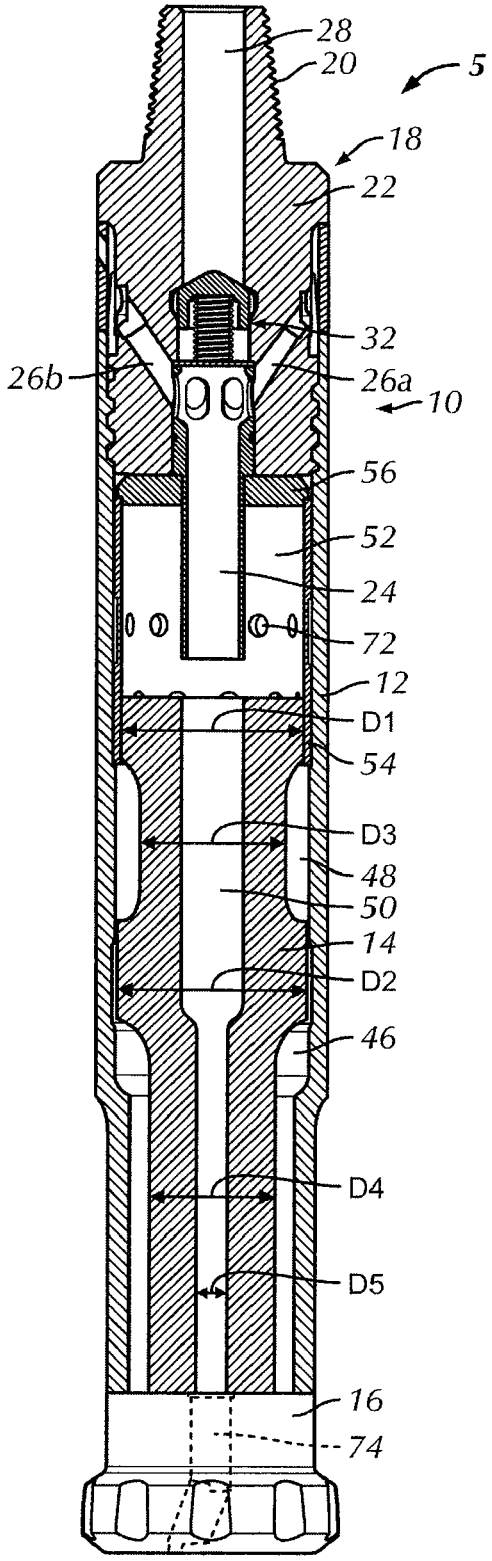
FIG. 1 is a side sectional elevational view of a DHD hammer in accordance with a preferred embodiment of the present invention.

Certain terminology is used in the following description for convenience only and is not limiting. The words "right," "left," "upper," and "lower" designate directions in the drawings to which reference is made. For purposes of convenience, "distal" is generally referred to as toward the drill bit end of the DHD hammer, and "proximal" is generally referred to as toward the backhead end of the DHD hammer as illustrated in FIG. 1. The terminology includes the words above specifically mentioned, derivatives thereof, and words of similar import.

Figure 2:
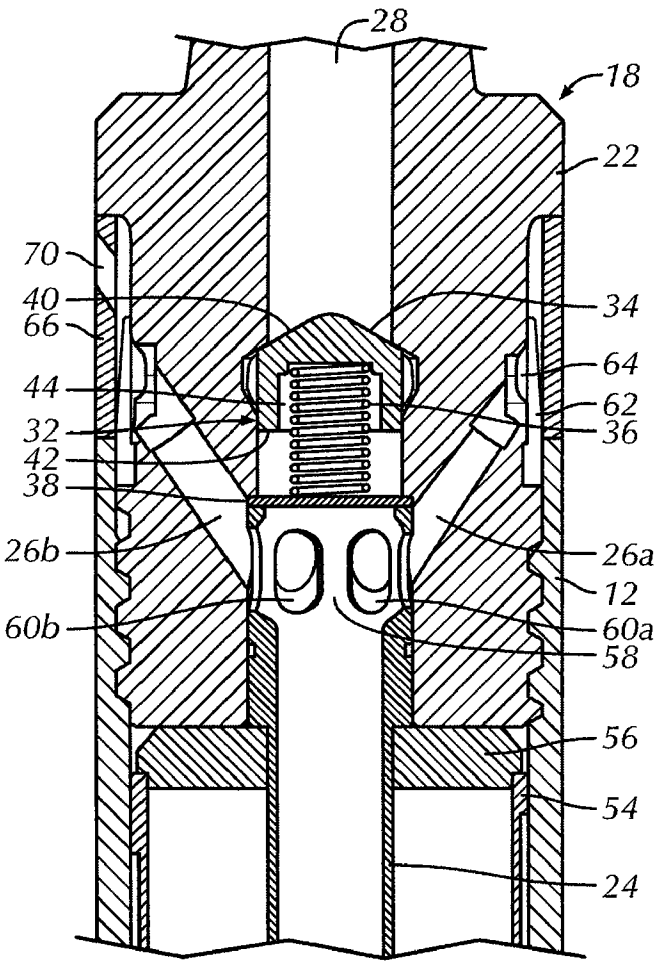
FIG. 2 is a greatly enlarged side sectional elevational view of a check valve assembly of the DHD hammer of FIG. 1.

In a preferred embodiment, the present invention provides for a DHD hammer 5 having a percussive actuator assembly 10 as shown in FIGS. 1 and 2, for use with a conventional down-the-hole drill pipe (not shown). Referring to FIG. 1, the DHD hammer 5 includes an actuator assembly 10, a casing 12, such as an elongated housing 12, and a drill bit 16. The actuator assembly 10 includes a piston 14, a backhead 18, a cylinder 54, and a cylinder cap 56. The piston 14 is generally housed within the casing 12 with its proximal end slidingly engaging the interior of the cylinder 54.

The piston 14 is generally configured as shown in FIG. 1. The piston 14 includes spaced apart major cross-sectional areas D1 and D2 and spaced apart minor cross-sectional areas D3 and D4. Major cross-sectional area D1 is configured about the most proximal end of the piston 14 and is sized so as to be housed within the cylinder 54. Major cross-sectional area D2 is configured distal to major cross-sectional area D1 and sized so as to be housed within the casing 12. The minor cross-sectional area D3 is configured between the major cross-sectional areas D1 and D2 so as to form the generally annular reservoir 48 between an outer surface of the piston 14 and an inner surface of the casing 12. The minor cross-sectional area D4 is configured distal to the major cross-sectional area D2 and generally defines the overall dimensions of the lower portion of the piston 14.

The piston 14 also includes a central bore 50 (e.g., a thru-bore) configured along a central axis of the piston 14 as shown in FIG. 1. The central bore 50 includes a proximal end and a distal end. The proximal end of the central bore 50 is sized so as to receive an exhaust valve stem 24. The distal end of the central bore 50 is sized so as to control the overall percentage of flow and rate of flow of working air volumes from a return chamber 46 to exhaust ports 26*a*, 26*b* so as to advantageously provide the proper amount of air to exhaust through the drill bit 16 and the backhead 18, as further described below.

The DHD hammer 5 can be assembled to a drill pipe (not shown) via threaded connections, such as with threads 20. The drill pipe can be any conventional drill pipe whose structure, function, and operation are well known to those skilled in the art. A detailed description of the structure, function, and operation of the drill pipe is not necessary for a complete understanding of the present embodiment. However, the drill pipe supplies the DHD hammer 5 with high pressure air, feed force, and rotation. It will be appreciated that while air is the preferred gas used in conjunction with the present invention, some other gas, combination of gases or fluids could also be used. The drill pipe is also typically smaller in diameter than the DHD hammer 5 (which can typically be about 2⅞ to about 12 inches in diameter).

Figure 3:
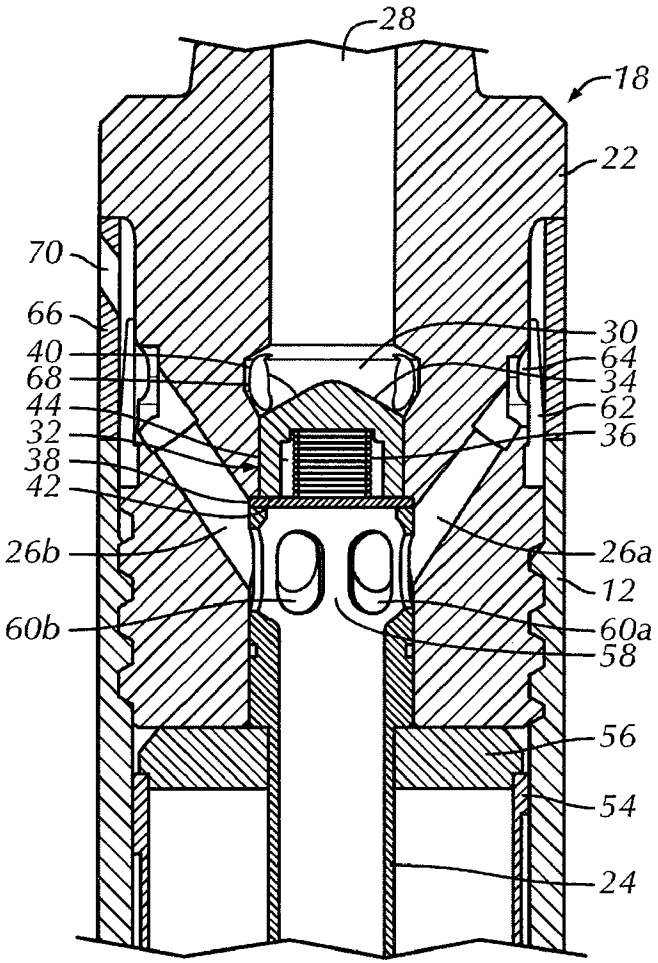
FIG. 3 is an enlarged side sectional elevational view of the DHD hammer of FIG. 1 with the check valve assembly in the open position.

As best shown in FIGS. 2 and 3, the backhead 18 includes a tubular member 22, such as a tubular casing or a cylindrical member, having the exhaust valve stem 24 (i.e., an elongated tubular body member), at least one but preferably a plurality of exhaust ports 26*a*, 26*b* (only two exhaust ports are shown for illustration purposes), a supply inlet 28, a central bore 30 for housing a check valve assembly 32, and a flapper check valve 62. The backhead 18 is threadingly connected to the casing 12 and configured to be operatively associated with the piston 14. The check valve assembly 32 is generally configured to provide a valve function for the flow of pressurized air received within the supply inlet 28.

The check valve assembly 32 includes a supply check valve 34, a biasing member, such as a spring 36 between the supply check valve 34 and an abutment 38. The abutment 38 is positioned distal to the supply check valve 34 and above a guide cage 58. The abutment 38 can also be configured as a top surface of the guide cage 58 and positioned within the central bore 30 so as to seal or block the flow of air between the supply inlet 28 and the exhaust valve stem 24. The check valve assembly 32 is operatively associated with the supply inlet 28. The supply check valve 34 is of a generally cylindrical configuration having a closed end 40 and an open end 42 with an inner bore 44. The inner bore 44 houses one end of the spring 36 for reciprocal motion of the spring 36 therein. The supply check valve 34 is positioned within the central bore 30 such that upon compression of the check valve assembly 32, the supply check valve 34 rests upon the abutment 38.

Figure 8:
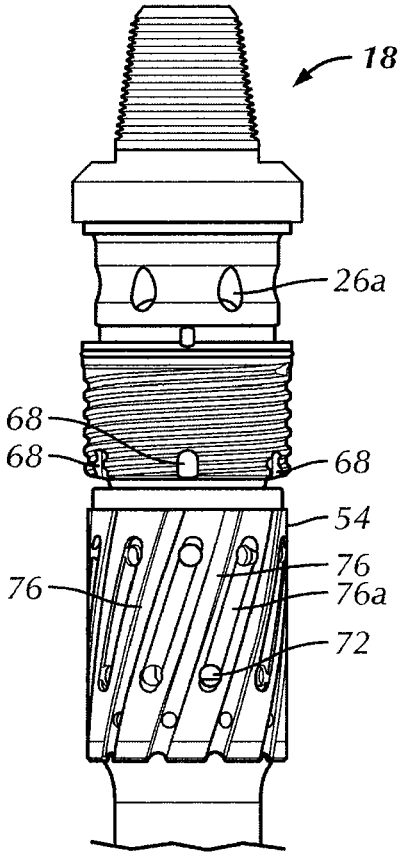
FIG. 8 is a side elevational view of the DHD hammer of FIG. 1 without a casing, a backhead sleeve or a flapper check valve.
Figure 6:
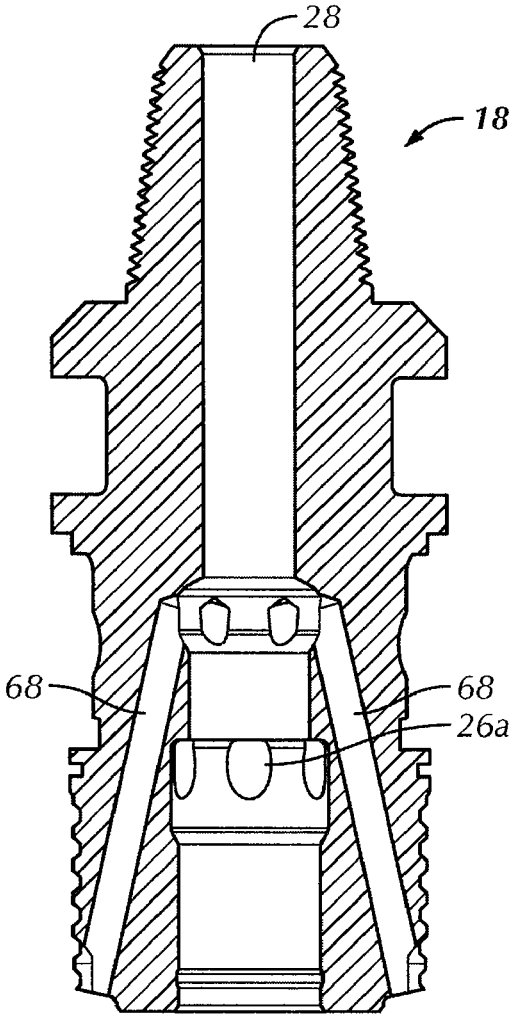
FIG. 6 is an enlarged, side sectional elevational view of a backhead of the DHD hammer of FIG. 1 rotated 90 degrees relative to the view of the backhead shown in FIG. 1.

The check valve assembly 32 is configured to control the flow of high pressure air from the supply inlet 28 to the reservoir 48 (FIG. 1) to percussively drive the piston 14. As shown in FIG. 2, the supply check valve 34 is in the closed position thereby creating a seal (such as a hermetic seal) between the upper surface of the supply check valve 34 and the tubular member 22 for preventing the flow of high pressure air from the supply inlet 28 to the reservoir 48. FIG. 3 illustrates the supply check valve 34 in the open position. In the open position, high pressure air flows down the supply inlet 28, past the supply check valve 34, and then to the reservoir 48 through passages 68 (FIGS. 3, 6 and 8) that are in communication with the reservoir 48 and the central bore 30.

Figure 7:
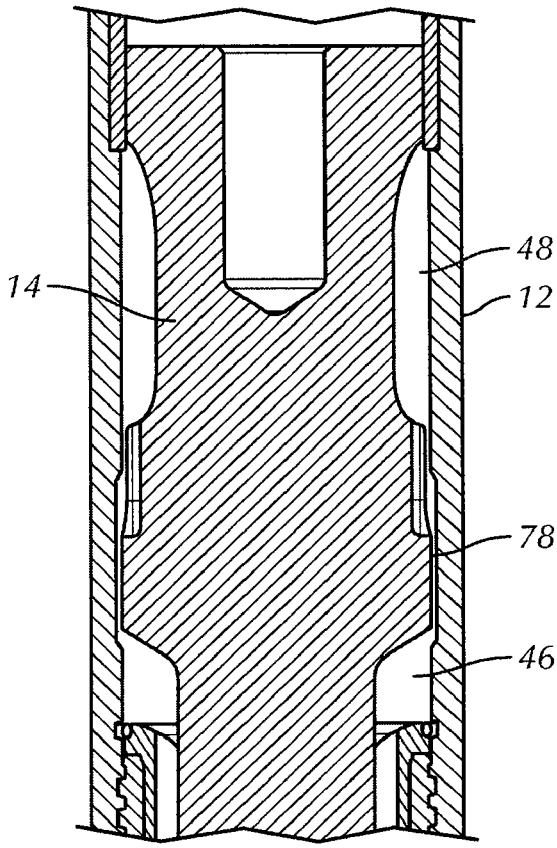
FIG. 7 is an enlarged, side sectional elevational view of a piston of the DHD hammer of FIG. 1.

Thereafter, the high pressure air in the reservoir 48 feeds the drive chamber 52 and return chamber 46 through a series of ports 76, 76*a* (FIG. 8) formed on the cylinder 54 and a passageway 78 (FIG. 7) bounded by the piston 14 and the casing 12. The series of ports 76, 76*a* are either open or closed to the driver chamber 52 depending upon the position of the piston 14 within the casing 12. Such porting configuration of the series of ports are well known in the art and a detailed description of their structure and function is not necessary for a complete understanding of the present embodiment. The high pressure air in the reservoir 48 cyclically opens and closes the series of ports to effectuate pressurization of the drive chamber 52 and return chamber 46 to drive the percussive movement of the piston 14 within the actuator assembly 10.

The guide cage 58 includes a number of slots 60*a*, 60*b* (only two shown for illustration purposes) in communication with exhaust ports 26*a*, 26*b* (only two shown for illustration purposes), respectively. The slots 60*a*, 60*b* are aligned with the exhaust ports 26*a*, 26*b* to minimize flow resistance and buildup of backpressure while the guide cage 58 is preferably configured with a plurality of slots. The guide cage 58 can alternatively be configured with any other type of opening that allows for the flow of air from the exhaust valve stem 24 to the exhaust ports 26*a*, 26*b*, such as an opening or a plenum.

The flapper check valve 62 is configured as an annular flexible valve that seats in an annulus 64. The flapper check valve 62 can be made from any material suitable for its intended use, such as a polymer (e.g., elastomers, plastics, etc.) or a composite material. The size and thickness of the flapper check valve 62 can advantageously be configured to compensate for any spacing gaps between the backhead 18 and outer casing 12.

Referring to FIGS. 1-3, in operation, as high pressure air is supplied to the actuator assembly 10, the high pressure air opens the supply check valve 34. The supply check valve 34 remains open as long as high pressure air is supplied to the DHD hammer 5. As high pressure air flows past the supply check valve 34, air fills the reservoir 48 and thereafter feeds the return chamber 46 and drive chamber 52 creating working air volumes that move the piston 14 in a percussive manner within the casing 12.

The cylinder 54 has a plurality of supply ports 72 and a cylinder cap 56 that seats on top of the cylinder 54. As high pressure air from the reservoir 48 fills the drive chamber 52, through the series of ports, the drive chamber 52 is filled or pressurized to cause the piston 14 to accelerate toward impact with the drill bit 16. Thereafter, high pressure air from the reservoir 48 fills the return chamber 46 to move the piston 14 back up into the drive chamber 52.

In operation, as high pressure air is supplied to the DHD hammer 5, the high pressure air causes the check valve assembly 32 to open. High pressure air then flows through a passage 68 and into a reservoir 48. The reservoir 48 then feeds the high pressure air to a drive chamber 52 and a return chamber 46 to effectuate percussive movement of the piston 14. As the piston 14 percussively moves within the casing 12, it allows for either the drive chamber 52 to exhaust the high pressure air i.e., working air volumes or the return chamber to exhaust working air volumes. That is, as the piston 14 moves distally, the distal end of the piston 14 sealingly engages a stem bearing seal (not shown) that prevents working air volumes from the return chamber 46 from exhausting, while allowing the working air volumes from the drive chamber 52 to exhaust. As the piston 14 moves proximally, the proximal end of the piston 14 sealingly engages the exhaust valve stem 24 to prevent working air volumes from the drive chamber 52 from exhausting, while allowing the working air volumes from the return chamber 46 to exhaust.

As high pressure air is exhausted through exhaust ports 26*a*, 26*b*, it initially travels through the exhaust valve stem 24 before entering into annulus 64. The air traveling through exhaust valve stem 24 enters guide cage 58, flows through slots 60*a*, 60*b* and then travels through exhaust ports 26*a*, 26*b*. The exhausting air flow then enters annulus 64 where it disperses to exert an evenly applied radial opening pressure (i.e., an opening force) upon flapper check valve 62. The flapper check valve 62, being made from materials such as an elastomer, closes due to the restoring forces of the material upon the absence of air being exhausted from the DHD hammer 5, thereby preventing debris from entering the DHD hammer 5. The exhausting air then exits the DHD hammer 5 through one or more openings 70 in a backhead sleeve 66 that allows for the passage of air from within the annulus 64 to exist the DHD hammer 5. The backhead sleeve 66 surrounds the backhead 18 and is configured about an upper end of the casing 12. This effectively results in about 70% of the total air in the DHD hammer 5 being exhausted above the drive chamber 52 or near the top of the actuator assembly 10, thereby significantly reducing the amount of air flowing past the drill bit's cutting face.

Exhausting air back through the top of the actuator assembly 10 advantageously results in less backpressure within the DHD hammer 5. This advantageously provides improved power and performance of the tool as less backpressure means less counteracting forces upon the air pressure used to power the DHD hammer 5. In addition, less high velocity flow across the drill bit's cutting face is induced which results in less overall part wear. This is a direct result of exhausting air closer to the top-end of the DHD hammer 5, where the external air pressure outside the DHD hammer 5 is lower due to the drill pipe diameter being smaller than the overall diameter of the DHD hammer 5. Typically, the external flow area above a DHD hammer 5 in the region where the drill pipe is connected is approximately 3 times larger than the external area around the DHD hammer itself. As a result, the dynamic pressure about the top end of the DHD hammer 5 can be about 9 times lower than the pressure toward the bottom end of the DHD hammer 5.

Moreover, exhausting air through exhaust ports 26*a*, 26*b* located above the piston 14 and having a relatively large internal diameter relative to typical air passageways in DHD hammers results in reduced flow velocities and less backpressure within the overall DHD hammer 5.

In another preferred embodiment, the present invention provides for an actuator assembly 110, as shown in FIGS. 4, 4A, 5 and 5A that includes a backhead 118, a drive chamber 152, a piston 114, a return chamber 146, and a drill bit 116. The actuator assembly 110 is configured substantially the same as that of the previous described embodiment of FIGS. 1-3. However, the actuator assembly 110 of the present embodiment is configured with a piston 114 without a central thru-hole for the passage of air through the piston 114 (i.e., a solid core piston). As such, the solid core piston 114, due to its sold core configuration, effectively seals and separates the drive chamber 152 and return chamber 146 exhaust ports i.e., exhaust ports 126*a*, 126*b* and return exhaust port 126, respectively. In addition, the solid core piston 114 further aids in preventing debris from entering the actuator assembly 110. The solid core piston 114 is situated between the drive chamber 152 and the return chamber 146. The drive chamber 152 and return chamber 146 are formed partially out of a proximal and a distal surface of the solid core piston 114, respectively.

Figure 5:
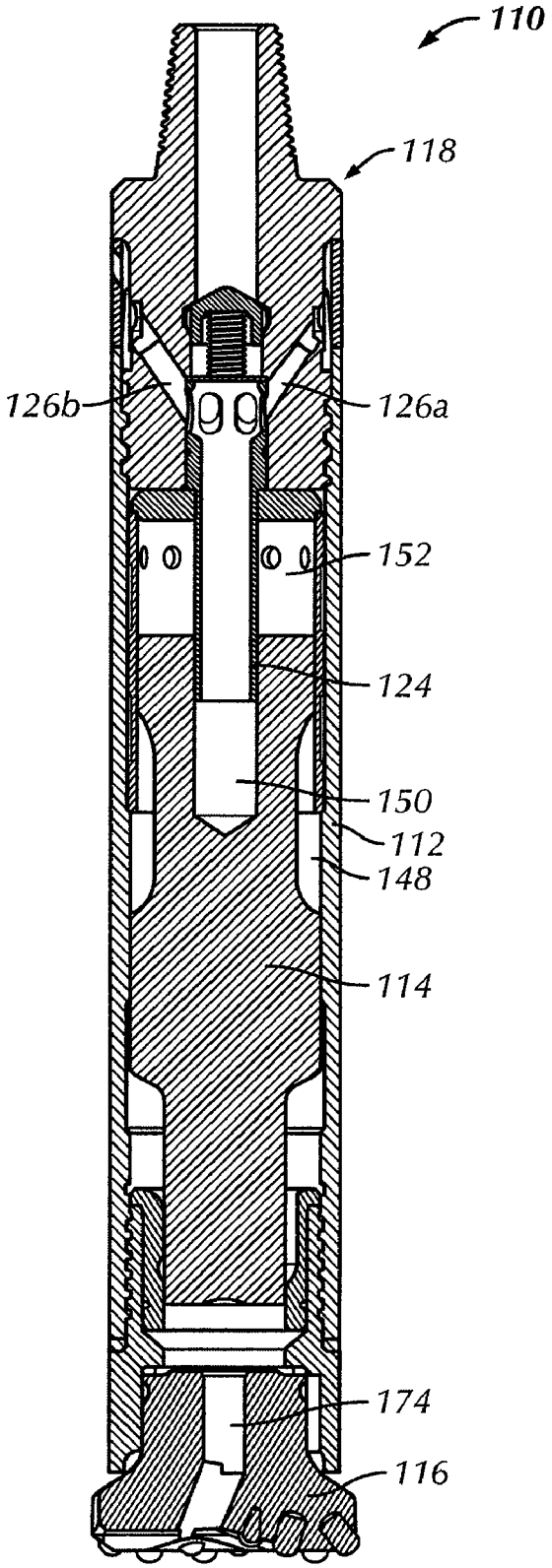
FIG. 5 is a side sectional elevational view of a DHD hammer with a solid core piston in accordance with yet another preferred embodiment of the present invention with a piston partially spaced from the drill bit and sealingly engaging an exhaust valve stem.
Figure 5A:
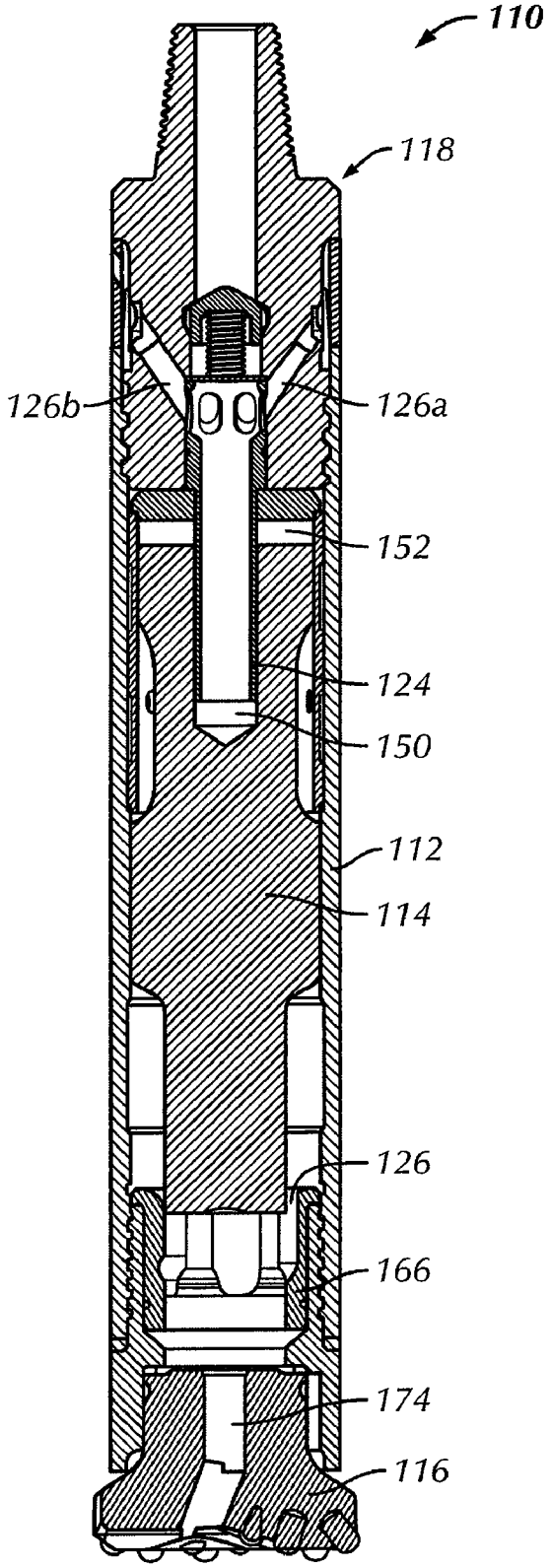
FIG. 5A is a side sectional elevational view of the DHD hammer of FIG. 5 with the piston fully spaced from the drill bit.

The drive chamber 152 is configured to exhaust working air volumes through the backhead 118. The return chamber 146 is configured to exhaust working air volumes through a central opening 174 in the drill bit 116. Referring to FIG. 5, as the solid core piston 114 moves away from the drill bit 116, the solid core piston bore 150 sealingly engages the exhaust valve stem 124 to prevent the drive chamber 152 from exhausting working air volumes. Referring to FIG. 5A, as the solid core piston 114 moves more fully upwardly and away from the drill bit 116, a return exhaust port 126 formed between the distal end of the piston 114 and a stem bearing seal 166 fully opens to allow for working air volumes from within the return chamber 146 to be exhausted through the central opening 174 in the drill bit 116. The central opening 174 provides a primary flow channel to allow working air volumes to flow from the return chamber 146 through the drill bit 116.

Figure 4:
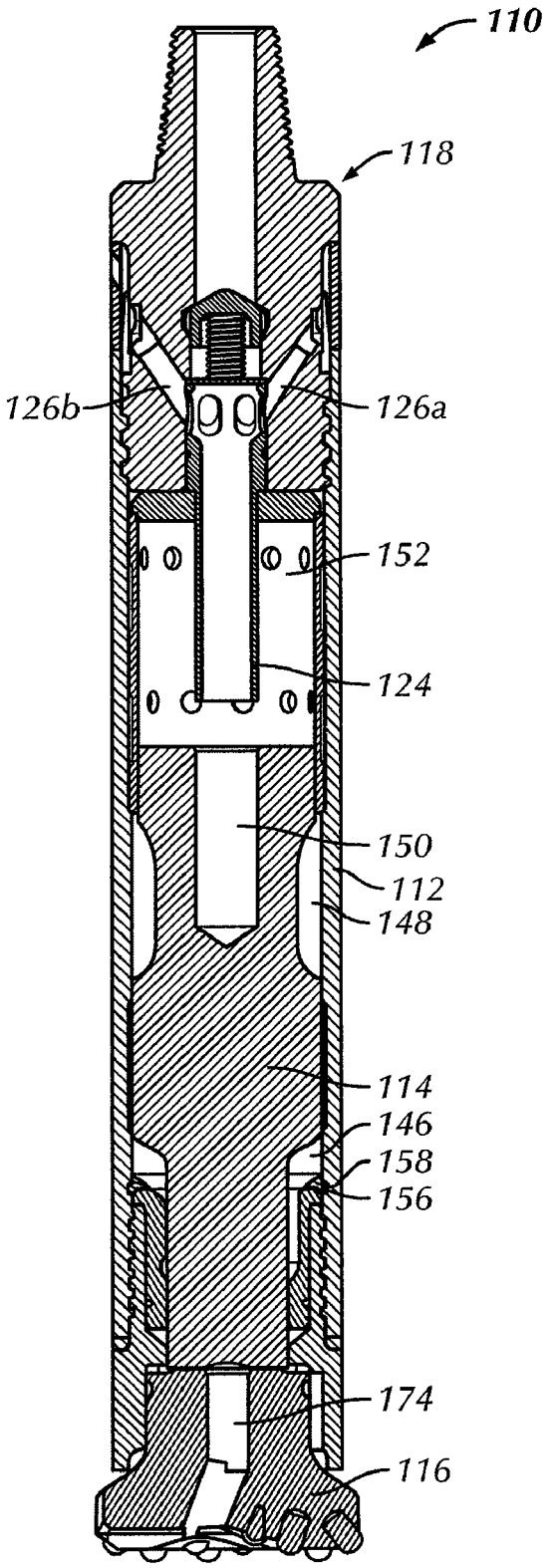
FIG. 4 is a side sectional elevational view of a DHD hammer with a solid core piston in accordance with another preferred embodiment of the present invention.
Figure 4A:
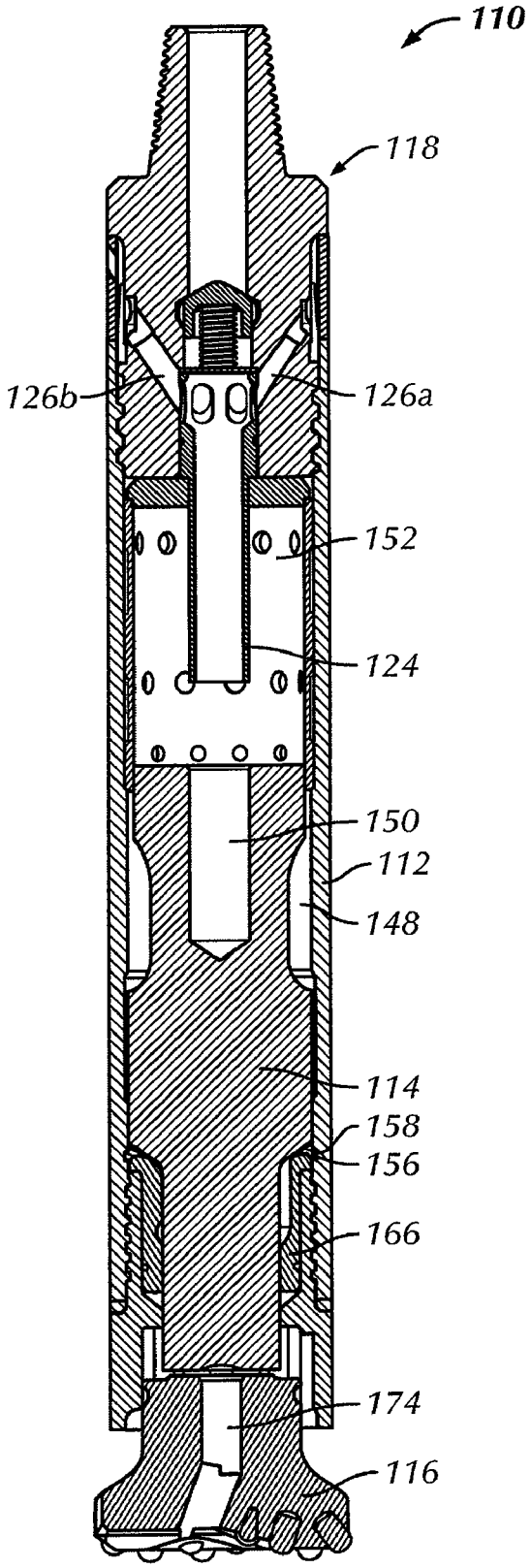
FIG. 4A is a side sectional elevational view of the DHD hammer of FIG. 4 with the piston in a "drop-down" position.

Referring to FIG. 4A, the actuator assembly 110 can optionally include a seal 156, such as an O-ring seal or an elastomeric seal, to sealingly engage the solid core piston 114 and casing 112 when the actuator assembly 110 is in its "drop-down" position. In the "drop-down" position, the DHD hammer is no longer in direct contact with a drilling surface (i.e., the DHD hammer is no longer actively drilling against a surface) and the piston 114 and drill bit 116 are in their most distal positions.

The seal 156 provides a means to seal off the return chamber 146 from the rest of the actuator assembly 110 above the return chamber 146 to advantageously prevent debris from entering the actuator assembly while in the "drop-down" position. The seal 156 can be positioned about an upper portion of the stem bearing 166 such that when the piston 114 is in the "drop-down" position, it sealingly interfaces with the piston 114 and casing 112. Preferably, the seal 156 is seated within a groove 158 within an inner surface of the casing wall.

The actuator assembly 110 of the present embodiments advantageously provide for a DHD hammer in which substantially all of the working air volume in the drive chamber 152 can be exhausted through the backhead 118 while substantially all of the working air volume in the return chamber 146 can be exhausted through the drill bit 116. As previously noted, it is problematic to have extremely high velocity flows past the drill bit face, but with conventional DHD hammers, it was necessary to exhaust working air volumes from the DHD hammer to remove drilling debris from the drill bit 116. However, the inventors of the instant invention have discovered that exhausting substantially all of the working air volumes above the drill bit 116 also resulted in clogging of the central opening 174 of the drill bit 116 due to insufficient blow out through the drill bit 116. Clogging of the drill bit 116 by drilling debris leads to failure of the DHD hammer such that penetration by the DHD hammer ceases. In sum, the inventors of the instant invention have discovered that one cannot simply exhaust all or substantially all working air volumes through the proximal end of a DHD hammer without incurring significant operational problems, such as drill bit clogging.

To address this problem, the inventors of the instant invention have surprisingly discovered that not all of the working air volumes need to be exhausted through the drill bit 116 to prevent clogging of the drill bit 116. In fact, the inventors discovered that exhausting the working air volume from the return chamber 146 alone through the drill bit 116 provided sufficient "blow-out" of the central opening 174. This was accomplished by restricting the flow of working air volume in the return chamber 146 back to the proximal end of the DHD hammer through the use of a solid core piston 114 with only a central bore 156 configured to receive exhaust valve stem 124. In other words, the central bore 156 is not a thru-bore. The solid core piston 114 also advantageously prevents debris from entering the distal or lower portion of the DHD hammer and provides added structural integrity to the overall DHD hammer. This is significant as conventional DHD hammers generally suffer from structural integrity issues as a result of pistons having thru-bores.

Referring back to FIG. 1, the problem of clogging of the drill bit's central opening 74 can alternatively be addressed through sizing of the opening D5 of the distal end of the central bore 50 to partially exhaust working air volumes through the piston 14 and partially through the drill bit 16. Sizing of the opening D5 of distal end of the central bore 50 to be about 0.001% to about 4.0%, and more preferably from 0.001% to about 1.0%, of the overall cross-sectional area D2 of the piston 14, allows for the pressure in the return chamber 46 to substantially reach line pressure (i.e., the pressure supplied by the drill pipe). Allowing the pressure in the return chamber 46 to substantially reach line pressure can provide sufficient pressure for blow out of the central opening 74, thus preventing clogging of the drill bit 16. For example, the opening D5 of distal end of the central bore 50 can be configured to be about 0.01 inches to about 0.75 inches in diameter for a piston 14 having an overall diameter of about 4⅝ inches.

Furthermore, it was generally accepted that conventional DHD hammers required air to be continuously exhausted though the drill bit 116 when the DHD hammer was in the "drop-down" position (see FIG. 4A) to "blow-out" drilling debris from the drilling hole during normal use. However, the inventors of the instant invention have also surprisingly discovered that this is not necessary. That is, there exits a critical quantity of exhaust necessary to prevent clogging of the drill bit 116 and to sufficiently "blow-out" the drill hole when the DHD hammer is in the "drop-down" position. This critical quantity of exhaust is approximately equal to the exhaust generated by the return chamber 146 when the DHD hammer is in the "drop-down" position.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A down-the-hole drill actuator assembly comprising:
a casing;
a drill bit engaged with the casing;
a backhead positioned within the casing, the backhead including at least one exhaust port in communication with an exterior of the casing proximate the backhead;
a drive chamber in communication with the at least one exhaust port; and
a piston between the drive chamber and the return chamber, wherein the working fluid volumes are exhausted from the at least one exhaust port to an exterior through the casing wall and proximate the backhead.

2. The down-the-hole drill actuator assembly of claim 1, further comprising:
a return exhaust port in communication with the return chamber; and
wherein the piston is housed within the casing between the at least one exhaust port and the return exhaust port.

3. The down-the-hole drill actuator assembly of claim 2, wherein the piston is a solid core piston and wherein the at least one exhaust port is sealed from the return exhaust port by the solid core piston.

4. The down-the-hole drill actuator assembly of claim 2, further comprising a seal to sealingly engage an interface between the piston and casing.

5. A down-the-hole drill actuator assembly comprising:
a casing;
a backhead configured within the casing, the backhead including:
a cylindrical member,
a central bore within the cylindrical member,
a check valve assembly within the central bore,
a supply inlet in communication with the central bore,
an exhaust valve stem in communication with the central bore, and
at least one exhaust port in communication with the exhaust valve stem and an exterior of the actuator assembly; and
a piston housed within the casing and operatively associated with the backhead, the piston comprising a bore partially sized to exhaust a portion of a fluid within the casing there through.

6. The down-the-hole drill actuator assembly of claim 5, further comprising:
at least one flapper check valve configured about an outside surface of the cylindrical member and connected to a discharge end of the at least one exhaust port; and
wherein the check valve assembly comprises:
a supply check valve;
a guide cage that includes at least one opening in communication with the at least one exhaust port; and
a biasing member between the supply check valve and guide cage.

7. The down-the-hole drill actuator assembly claim 5, wherein the exhaust valve stem extends proud of a distal surface of the cylindrical member.

8. An actuator assembly comprising:

a casing;

a piston housed within the casing, the piston comprising a thru-bore sized to allow a fluid within the casing to partially exhaust through;

a drill bit connected to a distal end of the casing and operatively associated with the piston; and a backhead connected to a proximal end of the casing and operatively associated with the piston, the backhead comprising:

an exhaust port in communication with an exterior of the actuator assembly, and an exhaust valve stem in communication with the exhaust port, and wherein the fluid within the actuator assembly is exhausted through the exhaust port to the exterior of the actuator assembly, a drive chamber formed within the casing and in communication with the exhaust valve stem, a return chamber distal to the drive chamber, formed by an inner wall surface of the casing and an outer surface of the piston, and wherein the fluid is supplied to the drive chamber through the supply inlet, and wherein the casing, piston, and backhead are configured to exhaust fluid within the drive chamber through the exhaust port, and exhaust fluid within the return chamber through an opening in the drill bit.

9. The actuator assembly of claim 8, wherein about 30% of the fluid in the casing is exhausted through the drill bit and about 70% of the fluid is exhausted through the exhaust port.

10. The actuator assembly of claim 8, wherein substantially all of the fluid within the drive chamber exhausts through the exhaust port and substantially all of the fluid within the return chamber exhausts through the drill bit.

11. The actuator assembly of claim 8, wherein the piston has a thru-bore in which a portion of the thru-bore has a cross-sectional area of about 0.001% to about 4.0% of an overall cross-sectional area of the piston.

12. The actuator assembly of claim 8, wherein the exhaust valve stem has a hollow cylindrical body configured for sliding engagement with a central bore of the piston.

13. The down-the-hole drill actuator assembly of claim 1, further comprising:

a seal located between the solid core piston and the casing; and wherein the backhead further includes a valve configured to seal the exhaust port.

14. The down-the-hole drill actuator assembly of claim 13, further comprising a bearing operatively connected to the casing and configured to receive a portion of the solid core piston, wherein the solid core piston, the bearing, the seal, and the casing form a seal to prevent fluid communication to the drive chamber from a distal end of the down-the-hole drill actuator when the solid core piston is in a drop down position.

15. The down-the-hole drill actuator assembly of claim 14, wherein the seal directly contacts the bearing and the solid core piston.

16. The down-the-hole drill actuator assembly of claim 14, wherein the seal is located about a superior surface of the bearing.

17. The down-the-hole drill actuator assembly of claim 14, wherein the casing includes a groove for receiving the seal.

18. The down-the-hole drill actuator assembly of claim 13, wherein the valve is a flapper check valve.

* * * * *